US005822673A

United States Patent [19]

Tanjo

[11] Patent Number: 5,822,673

[45] Date of Patent: Oct. 13, 1998

[54] RESERVATION—TYPE DOCUMENT FEEDER

[75] Inventor: Toru Tanjo, Osaka, Japan

[73] Assignee: Mita Industrial Co., Ltd., Osaka, Japan

[21] Appl. No.: 971,108

[22] Filed: Nov. 14, 1997

[30] Foreign Application Priority Data

Nov. 29, 1996 [JP] Japan ..... 8-319600

[51] Int. Cl.[6] ..... G03G 15/00

[52] U.S. Cl. ..... 399/369; 271/3.01; 271/9.01; 399/373

[58] Field of Search ..... 399/369, 373, 399/367, 16, 17, 76, 77; 271/3.01, 3.15, 9.01, 9.02, 9.03, 9.04, 225; 355/75

[56] References Cited

U.S. PATENT DOCUMENTS

| | | | |
|---|---|---|---|
| 5,192,976 | 3/1993 | Kitajima et al. | 399/373 |
| 5,197,724 | 3/1993 | Kitajima et al. | 271/3.01 |
| 5,669,057 | 9/1997 | Whiting | 399/369 |

FOREIGN PATENT DOCUMENTS 7-90991 (B2) 10/1995 Japan .

*Primary Examiner*—Arthur T. Grimley
*Assistant Examiner*—Sophia S. Chen
*Attorney, Agent, or Firm*—Beveridge, DeGrandi, Weilacher & Young, LLP

[57] ABSTRACT

A document feeder having a main document setting plate for holding thereon a stack of document originals to be processed, an auxiliary document setting plate for holding thereon a stack of document originals to be processed after the processing of the document originals set on the main document setting plate, a transfer mechanism for transferring the document originals set on the auxiliary document setting plate to the main document setting plate, and a feeding mechanism for feeding the document originals set on the main document setting plate one by one to a processing position. The document originals are transferred from the auxiliary document setting plate to the main document setting plate in synchronization with the one-by-one document feeding from the main document setting plate to the processing position by the feeding mechanism.

6 Claims, 3 Drawing Sheets

RESERVATION— TYPE DOCUMENT FEEDER

BACKGROUND OF THE INVENTION

1. Field of the Invention

The present invention relates to a document feeder which is applied to an image forming apparatus such as a copying machine and adapted to feed a document original to an image formation position where the document original is subjected to an image forming process.

2. Description of the Related Art

Most of conventional document feeders for use in copying machines and the like are designed so as not to accept a stack of document originals until document originals previously set therein are all processed. Therefore, a user on standby for copying the next stack of document originals has to wait for the completion of the processing of the previous document originals in front of the copying machine. This results in a lower work efficiency.

In view of this, a so-called reservation-type document feeder has been proposed which is adapted to accept a stack of document originals even during the processing of document originals previously set therein and, upon completion of the processing of the previous document originals, automatically start processing the document originals newly set therein. A reservation-type document feeder is disclosed, for example, in Japanese Examined Patent Publication (KOKOKU) No. 7-90991 (1995).

The document feeder disclosed in this publication has a main document feeding portion and an auxiliary document feeding portion which each accept a stack of document originals. The document feeder further includes a document discharge portion for receiving the document originals discharged therein after the processing thereof. Where stacks of document originals are respectively set in the main document feeding portion and in the auxiliary document feeding portion, the document originals set in the main document feeding portion are separately fed one by one to a copying position, and subjected to a copying process in the copying position. After the copying process, the document originals are each discharged into the document discharge portion. When all the document originals set in the main document feeding portion are discharged into the document discharge portion, the document originals set in the auxiliary document portion are transferred one by one into the main document feeding portion. Upon completion of the transfer of all the document originals, the document originals are separately fed one by one to the copying position and subjected to the copying process in the same manner as described above. After the copying operation, the document originals are discharged into the discharge portion.

In the document feeder according to the prior art, however, much time is required from the start of the transfer of the document originals on standby for the next copying process to the completion of the copying of the document originals, because much time is spent to transfer the document originals one by one from the auxiliary document feeding portion to the main document feeding portion. This results in a reduced use efficiency of the copying machine. This tendency is remarkable where a large number of document originals are to be copied.

SUMMARY OF THE INVENTION

It is an object of the present invention to provide a document feeder which has a main document setting plate and an auxiliary document setting plate each adapted to hold a stack of document originals set thereon and is capable of efficiently transferring the document originals from the auxiliary document setting plate to the main document setting plate.

The document feeder according to the present invention has a main document setting plate for holding thereon a stack of document originals to be processed, an auxiliary document setting plate for holding thereon a stack of document originals to be processed after completion of the processing of the document originals set on the main document setting plate, a transfer mechanism for transferring the document originals set on the auxiliary document setting plate to the main document setting plate, a feeding mechanism for feeding the document originals set on the main document setting plate one by one to a processing position, and control means for controlling the transfer mechanism so that the document originals are transferred from the auxiliary document setting plate to the main document setting plate in synchronization with the document feeding from the main document setting plate to the processing position by the feeding mechanism.

In accordance with the present invention, the document originals set on the auxiliary document setting plate are transferred to the main document setting plate in synchronization with the one-by-one feeding of the document originals set on the main document setting plate. Therefore, the time required for the document transfer can be shortened in comparison with a case where the document transfer is carried out after completion of the feeding of the document originals from the main document setting plate.

In accordance with one embodiment of the present invention, the document feeder further includes a document discharge tray for receiving the document originals once fed to the processing position from the main document setting plate and then discharged therein, a document recycling mechanism for guiding to the main document setting plate the document originals once fed from the main document setting plate to the processing position and resetting the document. originals on the main document setting plate, document non-processing transportation means for performing a document non-processing transportation operation whereby the document originals once reset on the main document setting plate by the document recycling mechanism are discharged into the document discharge tray without processing the document originals, and associated transfer control means for controlling the transfer mechanism to transfer document originals set on the auxiliary document setting plate to the main document setting plate in synchronization with the document non-processing transportation operation performed by the document non-processing transportation means.

The document feeder according to the present invention may be of the type which has a so-called recycle document feeding function. If the document originals in one stack were recycled to be reset on the main document setting plate by the document recycling mechanism in parallel to the transfer of the document originals in the other stack from the auxiliary document setting plate to the main document setting plate, the document originals in the one stack would be mingled with the document originals in the other stack on the main document setting plate. In accordance with the invention, however, the document originals in the one stack are discharged into the document discharge tray through the so-called non-processing transportation after the resetting thereof, and the document originals in the other stack are transferred from the auxiliary document setting plate to the main document setting plate in synchronization with the non-processing transportation. Thus, the time required for the transfer of the document originals can be shortened in comparison with a case where the transfer of the document originals is carried out after completion of the document non-processing transportation.

The foregoing and other objects, features and effects of the present invention will become more apparent from the following description of the preferred embodiments with reference to the attached drawings.

DESCRIPTION OF THE PREFERRED EMBODIMENTS

Figure 1:
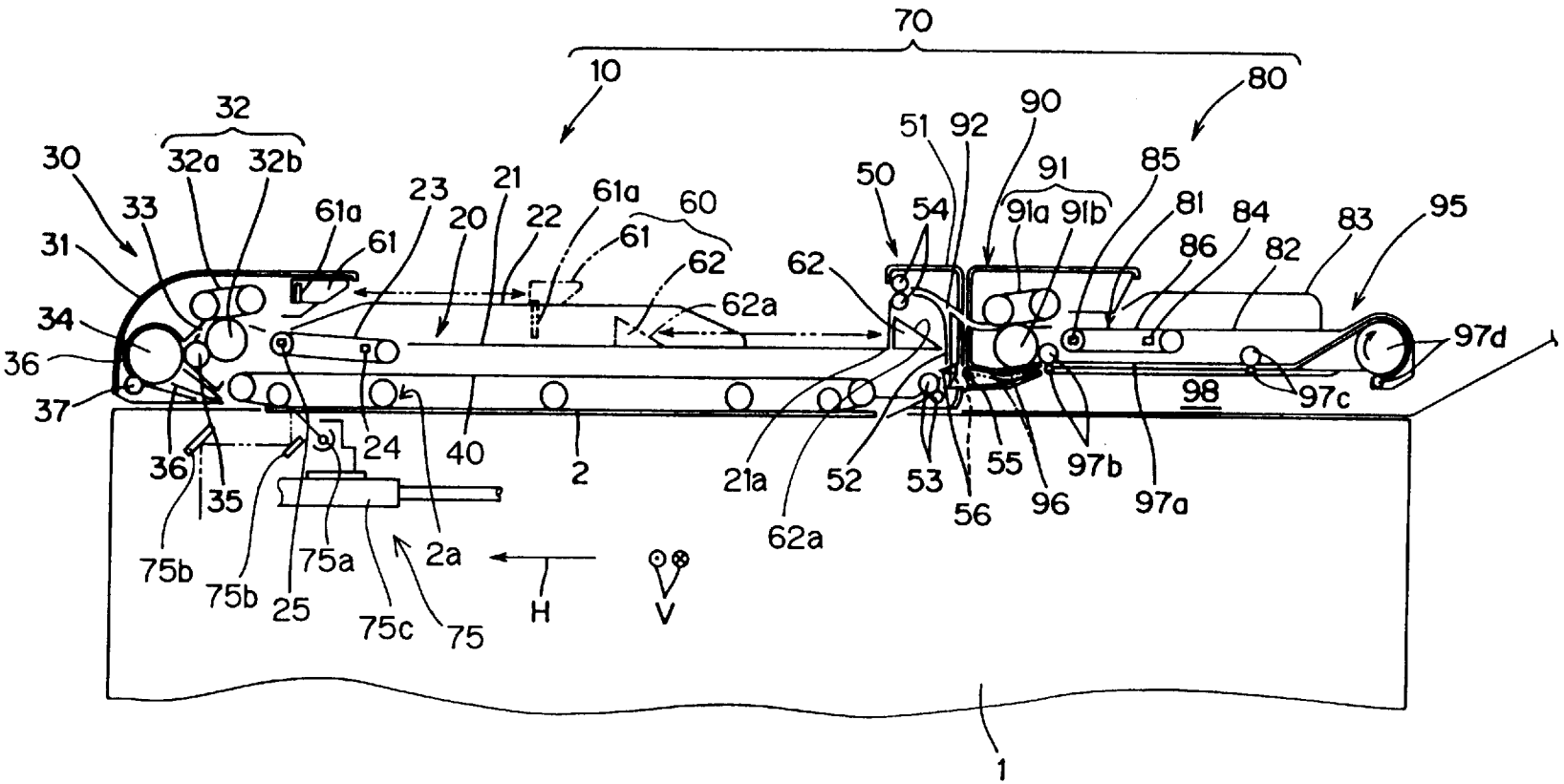
FIG. 1 is a sectional view illustrating the construction of a copying machine to which one embodiment of the present invention is applied.

FIG. 1 is a sectional view illustrating the construction of a copying machine to which one embodiment of the present invention is applied. The copying machine includes a copying machine body 1 and a reservation-type document feeder 70 mounted on the upper face of the copying machine body 1. The reservation-type document feeder 70 has a main document feeding portion 10 and an auxiliary document feeding portion 80.

The main document feeding portion 10 comprises a so-called automatic recycle document feeder (or RDH which stands for recycle document handler). The main document feeding portion 10 is adapted to automatically feed a document original to a copying position 2*a* (processing position) on a contact glass 2 provided on the upper face of the copying machined body 1, and then back to the original position after copying thereof, thereby allowing the document original to be automatically fed again to the copying position 2*a* on the contact glass 2.

Provided below the contact glass 2 is an illumination scanning system 75 for illuminating and scanning the document original placed on the upper surface of the contact glass 2.

The illumination scanning system 75 has a light source 75*a* for illuminating the document original, a plurality of reflector mirrors 75*b* for leading light emitted from the light source 75*a* and reflected on the document original into an image forming section not shown, and a driving mechanism 75*c* for moving the light source 75*a* and the reflector mirrors 75*b* laterally as seen in FIG. 1.

The image forming section includes, for example, a photoreceptor to be exposed to the light from the illumination scanning system 75, a main charger for uniformly charging the surface of the photoreceptor before the light exposure, a developer unit for developing an electrostatic latent image formed by the light exposure into a toner image, a transfer charger for transferring the toner image onto a sheet, and a fixing unit for fixing transferred toner particles on the sheet.

The auxiliary document feeding portion 80 is adapted to hold a stack of document originals to be copied after the copying of a stack of document originals set in the main document feeding portion 10.

The main document feeding portion 10 includes a main document setting portion 20 for holding the stack of document originals set thereon, a main feeder portion 30 for feeding the document originals set in the main document setting portion 20 one by one to the copying machine body 1, a transportation belt 40 for transporting a document original fed into the copying machine body 1 in a regular feeding direction or in a reverse feeding direction, a document discharge portion 50 for receiving the document original discharged from the copying machine body 1, and a document resetting portion 60 for guiding the discharged document original to a feeding position.

The main document setting portion 20 includes a main document setting plate 21. The main document setting plate 21 includes a pair of width regulating plates 22 for positioning the document original stack with respect to the width V of the main document feeding portion 10, and a forward feeding belt 23 for transporting the document original stack previously set in a main initial position to the feeding position. The main initial position is defined as a position where a user is allowed to place the document original stack on the main document setting plate 21. The feeding position is defined as a position at which the feeding of a document original is started.

When the document original stack is set in the main initial position, a preset switch 24 provided in the main initial position is turned on. In response thereto, the forward feeding belt 23 is rotatively driven. When the document original stack is transported to the feeding position, a set switch 25 provided in the feeding position is turned on. After a lapse of a predetermined time period from the turn-on of the set switch 25, the driving of the forward feeding belt 23 is stopped. Thus, the document original stack is set in the feeding position.

The main feeder portion 30 has a separator mechanism 32 provided within a feeder cover 31. The separator mechanism 32 has a separator belt 32*a* and a separator roller 32*b*. The separator belt 32*a* and the separator roller 32*b* cooperatively separate the lowermost one of the document originals set in the feeding position, and feed the separated document original into a document feeding path 33.

The document original fed into the document feeding path 33 is once stopped by a roller pair consisting of a registration/reverse roller 34 and a registration roller 35, and then fed toward the contact glass 2 in a predetermined timing by the roller pair. Thereafter, the document original is placed on the contact glass 2 of the copying machine body 1 by a transportation belt 40.

Where only one side of the document original is to be copied, the document original is subjected to a copying operation by the copying machine body 1 in this state.

Conversely, where both sides of the document original are to be copied, the document original is reversed before the document original is subjected to the copying operation by the copying machine body 1. More specifically, the document original once placed on the contact glass 2 is taken back to a document reversing path 36 by the transportation belt 40. The document original thus taken back is transported through the reversing path 36 by the rotation of the registration/reverse roller 34 and the reverse roller 37, and then transported onto the contact glass 2 by the rollers 34 and 35. Thus, the document original is placed on the contact glass 2 again and, in this state, subjected to the copying operation. That is, the back side of the document original is first copied. Thereafter, the document original is reversed again in the same manner as in the first reversing operation, and then placed on the contact glass 2 so as to be subjected to the copying operation. Thus, the front side of the document original is copied.

After the copying, the document original is transported to the document discharge portion 50 by the transportation belt 40. The document discharge portion 50 has a first discharge roller pair 53 and a second discharge roller pair 54 respectively disposed in the vicinity of upstream and downstream ends of a document discharge path (document recycling path) 52 provided within a discharge portion cover 51. A branch port 55 connected to a discharge portion 95 of the auxiliary document feeding portion 80 is provided downstream of the first discharge roller pair 53 in the midst of the document discharge path 52. A branch claw 56 is provided in association with the branch port 55. The branch claw 56 is displaceable between a document discharging position where the document discharge path 52 is closed and the branch port 55 is open as indicated by a solid line in FIG. 1 and a recycling position where the branch port 55 is closed and the document discharge path 52 is open as indicated by a two-dot-and-dash line in FIG. 1.

When the branch claw 56 is in the recycling position, the document original transported by the transportation belt 40 is taken into the document discharge path 52 by the first discharge roller pair 53, and then discharged onto the main document setting plate 21 by the second discharge roller pair 54. On the other hand, when the branch claw 56 is in the document discharging position, the document original is guided to the branch port 55 by the first discharge roller pair 53, then transported to the discharge portion 95 of the auxiliary document feeding portion 80, and discharged into a document discharge tray 98 of the discharge portion 95.

Where the document originals are to be recycled to the main document setting plate 21, the branch claw 56 assumes the recycling position. Where the document originals are to be transferred from the auxiliary document setting plate 82 to the main document setting plate 21, the branch claw 56 assumes the document discharging position. If only the main document setting portion 20 is used, the document originals are discharged onto the main document setting plate 21. If the auxiliary document setting portion 80 is used along with the main document setting portion 20, the document originals are discharged into the document discharge tray 98 as required.

The document original resetting portion 60 serves to reset document originals guided to the main document setting plate 21 with their leading edges aligned, and includes a document partition portion 61 for aligning the leading edges of the document originals, and a feed-out plate 62 for pushing the trailing edges of the document originals to feed out the document originals in a document original transportation direction H.

The document partition portion 61 is movable in the document original transportation direction H, and has a partition bar 61*a* which is either projected downward or retracted therein. When the copying operation is started, the document partition portion 61 is moved toward the upstream side in the document original transportation direction H, and then the partition bar 61*a* is projected downward as indicated by two-dot-and-dash lines in FIG. 1.

The document partition portion 61 is moved to a given position which depends on the size of the document originals guided from the document discharge portion 50 to the main document setting plate 21. More specifically, the document partition portion 61 is moved to a position such that the document originals are fitted in a space defined between a downstream edge 21*a* of the main document setting plate 21 and the partition bar 61*a* projected downward. With this arrangement, the leading edges of the document originals abut against the partition bar 61*a* so as to be aligned.

The feed-out plate 62 is movable in the document original transportation direction H, and is usually retracted in the discharge portion cover 51. When the copying operation is started, the feed-out plate 62 is moved to the vicinity of the trailing edge of the document original stack set in the feeding position. After one of the document originals is discharged, the feed-out plate 62 is retracted into the discharge portion cover 51. When a long document original is guided from the document discharge portion 50 to the main document setting plate 21, the leading edge of the first document original is guided to an upper side of the trailing edge of the document original stack set in the feeding position by a slant face 62*a* of the feed-out plate 62. The leading edges of second and subsequent document originals are guided by the first document original to the upper side of the trailing edge of the document original stack set in the feeding position.

This prevents the leading edge of the document original from bumping against the document originals set in the feeding position on standby for the copying operation, thereby preventing the document originals from being bent or folded.

After the document originals to be set on the main document setting plate 21 are all guided through the document discharge portion 50 to the main document setting plate 21, the feed-out plate 62 is moved in the document original transportation direction H. Thus, the document originals are transported in the document original transportation direction H. When the document originals reach the preset switch 24 to turn on the preset switch 24, the forward feeding belt 23 is automatically driven so that the document originals are drawn into the feeding position. After a lapse of the predetermined time period from the turn-on of the set switch 25, the driving of the forward feeding belt 23 is stopped. Thus, the document originals are set in the feeding position.

The auxiliary document feeding portion 80 is connected to the main document feeding portion 10 adjacent to the document discharge portion 50 of the main document feeding portion 10, and includes an auxiliary document setting portion 80 for holding a stack of document originals set therein, an auxiliary feeder portion 90 for separately feeding the document originals set in the auxiliary document feeding portion 81 one by one, and the discharge portion 95 for discharging a document original after copying thereof.

The auxiliary document setting portion 81 includes an auxiliary document setting plate 82. Like the main document feeding portion 10, the auxiliary document setting plate 82 is provided with width regulating plates 83 and a forward feeding belt 86 for transporting the document originals set in the auxiliary initial position to a transferring position. The auxiliary initial position is defined as a position where a user is allowed to set the document original stack in the auxiliary document feeding position 80, while the transferring position is defined as a position where the transfer of the document originals is started. A preset switch 84 and a set switch 85 each adapted to output a trigger signal for controlling the rotative driving of the forward feeding belt 86 are provided in the auxiliary initial position and the transferring position, respectively.

The auxiliary feeder portion 90 has a transfer mechanism 91. The transfer mechanism 91 has a transfer belt 91*a* and a transfer roller 91*b*, and is adapted to separately feed the document originals set in the transferring position one by one. A transferring path 92 inclines upward toward the main document feeding portion 10, and joins the document discharging path 52 on an upper side of the main document feeding portion 10. That is, a part of the document discharging path 52 serves as the transferring path 92. It is noted that the document discharging path 52 and the transferring path 92 may independently be provided.

The discharging portion 95 is provided below the auxiliary document setting plate 82, and includes the document discharging tray 98 for receiving a document original guided from the main document feeding portion 20 through the branch port 55. The document original to be discharged into the document discharge tray 98 is transported through different paths depending on the size of the document original.

More specifically, the discharge portion 95 has a vertically movable guide plate 96 which is provided in association with the branch port 55. If the size of the document original to be discharged into the document discharge tray 98 is smaller than a predetermined size (e.g., A4 size), the guide plate 96 is located in a lower position as indicated by a solid line in FIG. 1. If the size of the document original is larger than the predetermined size, the guide plate 96 is located in an upper position as indicated by a two-dot-and-dash line.

If the document size is smaller than the predetermined size, the document original is guided to the document discharge portion 50 by the transportation belt 40 after the completion of the copying process, and then guided to the discharge portion 95 through the branch port 55. Since the guide plate 96 is located in the lower position at this time, the document original is guided to a discharging path 97*a*. Thereafter, the document original is fed downstream of the discharging path 97*a* by discharge roller pairs 97*b* and 97*c*, and then discharged into the document discharge tray 98 after being reversed by a discharge roller pair 97*d*.

If the document size is larger than the predetermined size, the document original is returned to the reversing path 36 of the main document feeding portion 10 for reversion thereof after the completion of the copying process, and guided to the document discharge portion 50 by the transportation belt 40 and then to the discharge portion 95 through the branch port 55. Since the guide plate 96 is located in the upper position at this time, the document original is discharged directly into the document discharge tray 98.

The document original is once reversed in either of the aforesaid cases. This aims at stacking the document originals in the decreasing order of page number when the document originals are discharged into the document discharge tray 98.

Thus, the document originals having a larger size than the predetermined size are not transported through the discharging path 97*a* but discharged directly into the document discharge tray 98 after being reversed through the reversing path 36 which has a smaller length than the discharging path 97*a*. Accordingly, the document originals are speedily discharged into the document discharge tray 98 after the copying thereof, so that slow-down of the copying speed can be prevented.

Figure 2:
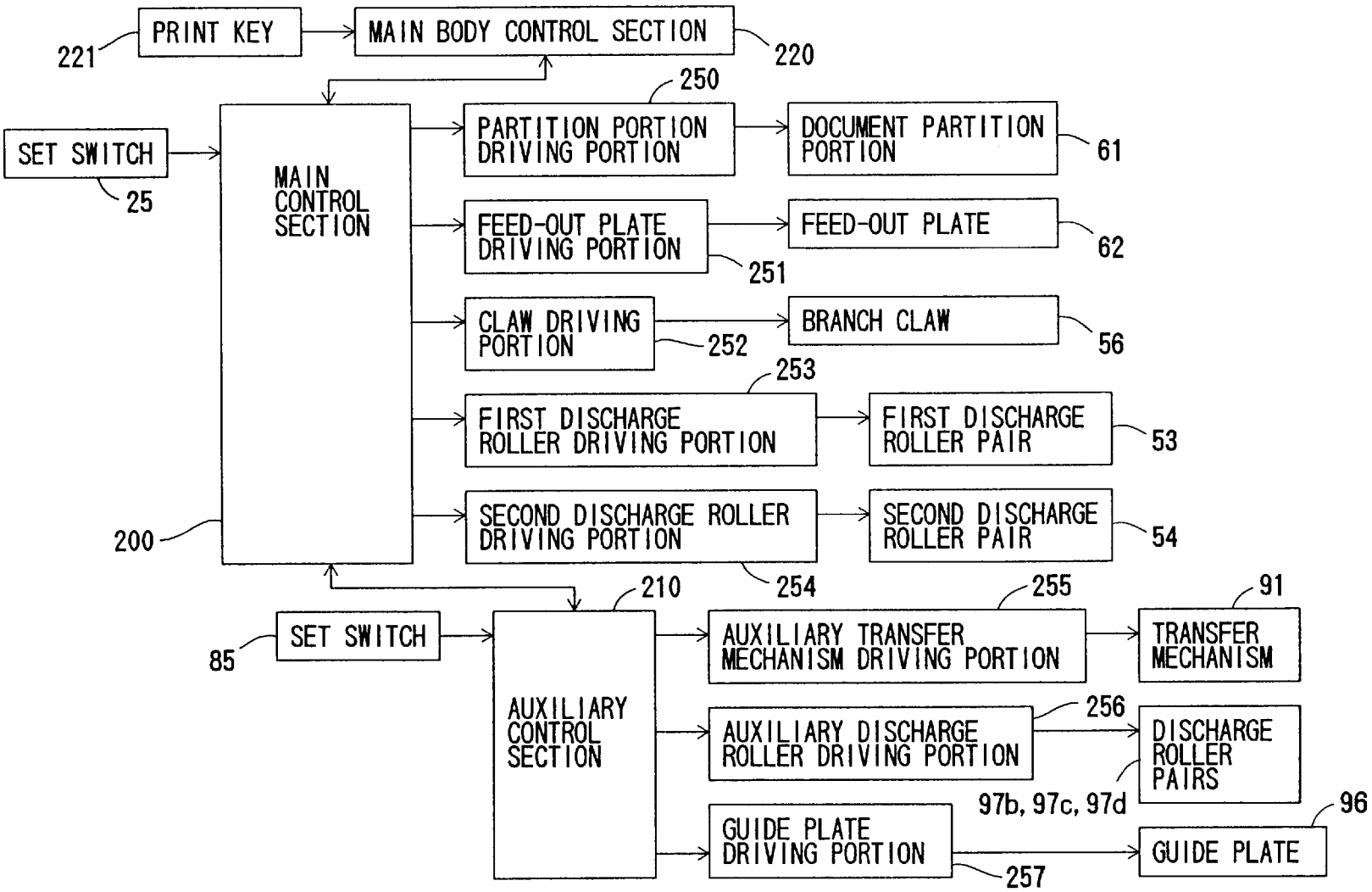
FIG. 2 is a block diagram illustrating an electrical construction related to transfer of document originals.

FIG. 2 is a block diagram illustrating an electrical construction related to the transfer of the document originals. The main document feeding portion 10 and the auxiliary document feeding portion 80 have a main control section 200 and an auxiliary control section 210, respectively, which function as control centers. The main control section 200 and the auxiliary control section 210 are comprised of a microprocessor. The main control section 200 and the auxiliary control section 210 are accessible to each other.

The main control section 200 is mutually accessible to a main body control section 220 which is a control center of the copying machine body 1. The main body control section 220 is comprised of a microprocessor, for example. The main body control section 220 receives an output of a print key 221 which gives a copy start command as an input signal.

The main control section 200 receives an output of the set switch 25 as an input signal. The main control section 200 accesses the auxiliary control section 210 to fetch therefrom ON/OFF information of the set switch 85 and the like inputted to the auxiliary control section 210.

The main control section 200 controls a partition portion driving portion 250 as a driver for the document partition portion 61, a feed-out plate driving portion 251 as a driver for the feed-out plate 62, a claw driving portion 252 as a driver for the branch claw 56, and first and second document discharge roller driving portions 253 and 254 as drivers for the first and second document discharge roller pairs 53 and 54 on the basis of the output of the set switch 25 and the ON/OFF information of the set switch 85.

The auxiliary control section 210 controls an auxiliary transfer mechanism driving portion 255 as a driver for the transfer mechanism 91, an auxiliary discharge roller driving portion 256 as a driver for the discharge roller pairs 97*b*, 97*c* and 97*d*, and a guide plate driving portion 257 as a driver for the guide plate 96.

Figure 3:
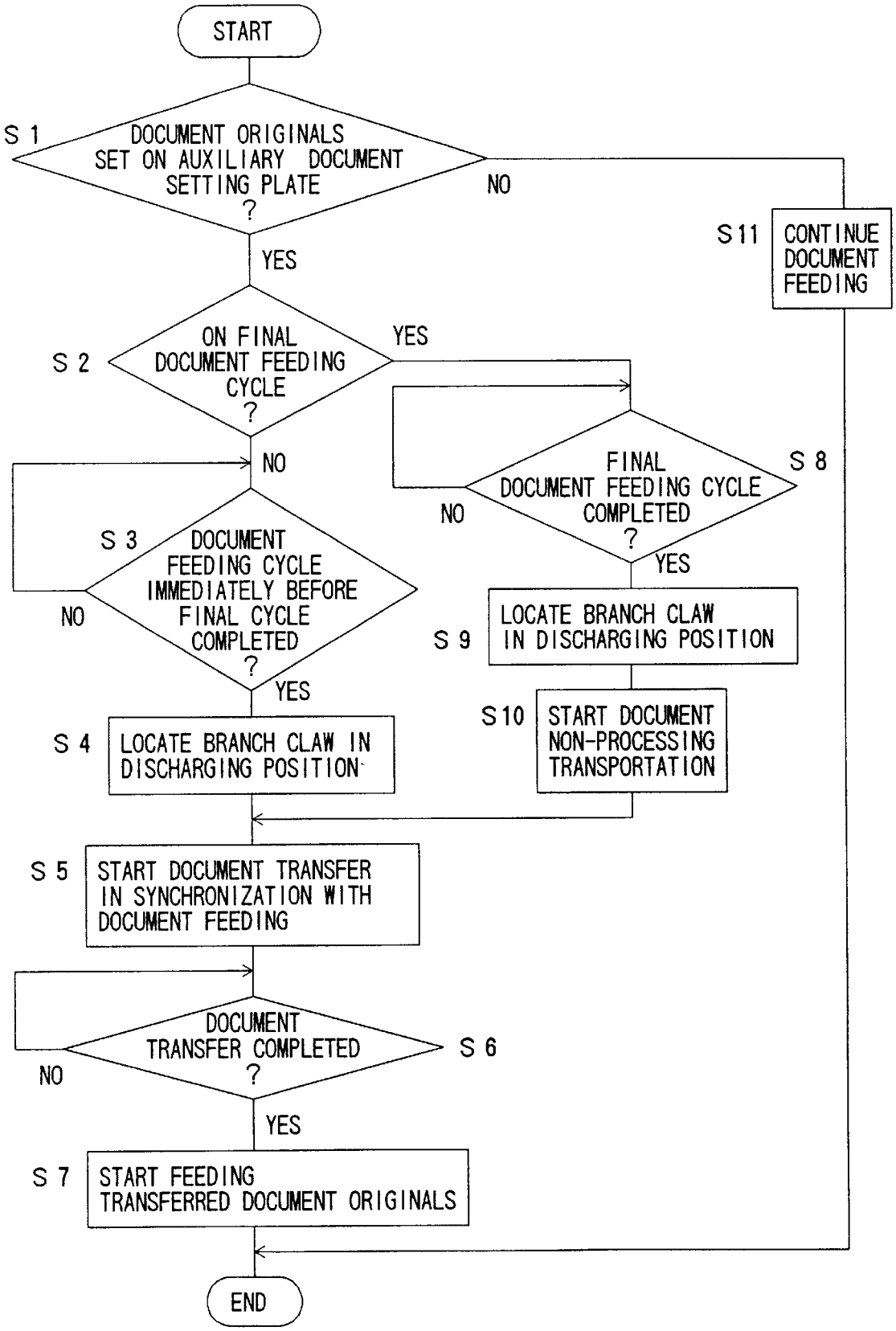
FIG. 3 is a flow chart for explaining a document transferring operation.

FIG. 3 is a flow chart for explaining a document transferring operation. When the print key 221 is pressed with a stack of document originals being set on the main document setting plate 21, the feeding of the document originals is started. At this time, the branch claw 56 is located in the recycling position so that document originals subjected to the copying process are discharged onto the main document setting plate 21.

When the feeding of the document originals once set on the main document setting plate 21 is carried out, the main control section 200 checks whether or not a stack of document originals is set on the auxiliary document setting plate 82 on standby for the next copying operation (Step S1). More specifically, the main control section 200 checks whether or not the set switch 85 on the auxiliary document setting plate 82 is turned on.

If no document stack is set on the auxiliary document setting plate 82, the document feeding operation is continued (Step S11). On the other hand, if the set switch 85 is turned on with a document stack being set on the auxiliary document setting plate 82 on standby for the next copying operation, the main control section 200 judges whether or not the document feeding operation has entered a final document feeding cycle (Step S2). As a result, if the main control section 200 judges that the document feeding operation has not entered the final document feeding cycle yet, the main control section 200 checks for completion of a document feeding cycle immediately before the final document feeding cycle (Step S3). The completion of the document feeding cycle is determined on the basis of a lapse of a first process time t1 from the turn-off of the set switch 25 on the main document setting plate 21. The first process time t1 is defined as a time required for the trailing edge of a document original to pass through the second discharge roller pair 54 from the set switch 25.

Upon the completion of the document feeding cycle immediately before the final document feeding cycle, the main control section 200 switches the branch claw 56 to the document discharging position (Step S4). Further, the main control section 200 accesses the auxiliary control section 210 to locate the guide plate 96 either in the upper position or in the lower position depending on the size of the document originals set on the main document setting plate 21. When the guide plate 96 is located in the lower position, the discharge roller pairs 97*b*, 97*c* and 97*d* are rotatively driven. Thus, the document originals on the main document setting plate 21 are all guided to the discharge portion 95 of the auxiliary document feeding portion 80 and discharged into the document discharge tray 98 after being subjected to the copying process.

Further, the main control section 200 accesses the auxiliary control section 210 to start transferring the document originals in association with the one-by-one feeding of the document originals in the final document feeding cycle (Step S5). The main control section 200 starts driving the second discharge roller pair 54. At the same time, the document partition plate 61 is moved laterally by a distance depending on the size of the document originals to be transferred, and the partition bar 61*a* is projected downward. Then, the feed-out plate 62 is moved in the document transportation direction H.

The auxiliary control section 210 drives the transfer mechanism 91 in response to a command from the main control section 200. As a result, the lowermost one of the document originals set on the auxiliary document setting plate 82 is separated and fed into the transferring path 92. Thereafter, the document original is guided onto the main document setting plate 21 by the second discharge roller pair 54. At this time, the feed-out plate 62 is out of the discharge portion cover 51. Therefore, if the document originals are long, the leading edges of the document originals guided onto the main document setting plate 21 are rested on the trailing edge of the document original stack set in the feeding position. Since the partition bar 61*a* is projected downward, the leading edges of the document originals guided onto the main document setting plate 21 abut against the partition bar 61*a* thereby to be restricted.

Thus, the document originals are transferred from the auxiliary document setting plate 82 to the main document setting plate 21 in association with the one-by-one feeding of the document originals from the main document setting plate 21. As a result, the document originals previously set on the auxiliary document setting plate 82 on standby for the next copying operation are successively stacked on the document originals set on the main document setting plate 21, and the leading edges thereof abut against the partition bar 61*a*thereby to be aligned.

The main control section 200 checks for the completion of the transfer of the document originals after giving a document transfer command (Step S6). More specifically, the main control section 200 checks whether or not a second process time t2 has elapsed since the turn-off of the set switch 85 on the auxiliary document setting plate 82. The second process time t2 is defined as a time required for the trailing edge of a document original being transferred to pass through the second discharge roller pair 54 from the set switch 85.

Where the document feeding from the main document setting plate 21 is completed before the main control section 200 checks for the completion of the document transfer, the document transfer may be carried out at a higher rate. With this arrangement, the document transfer can be completed more speedily. The completion of the document feeding from the main document setting plate 21 can be determined, for example, on the basis of the turn-off of the set switch 25.

If the main control section 200 determines in Step S6 that the document transfer is completed, the main control section 200 moves the feed-out plate 62 and rotatively drives the forward feeding belt 23 to set the transferred document originals in the feeding position. Thereafter, the feeding of the document originals is started (Step S7).

If the transferred document originals were discharged into the document discharge tray 98 of the auxiliary document feeding portion 80 with the previously discharged document originals being left in the document discharge tray 98, the transferred document originals would be mingled with the previously discharged document originals. In this embodiment, however, the main control section 200 discharges into the main document setting plate 21 the document originals transferred from the auxiliary document setting plate 82 with the branch claw 56 located in the recycling position.

If it is judged in Step S3 that the document feeding operation has entered the final document feeding cycle, some of the document originals set on the main document setting plate 21 are already subjected to the copying process and then discharged onto the main document setting plate 21. In such a case, the document transfer in association with the one-by-one document feeding would result in the mingling of the document originals.

To prevent this, the main control section 200 waits for the completion of the final document feeding cycle (Step S8), then shifts the branch claw 56 to the document discharging position (Step S9), and starts a document non-processing transportation operation (Step S10), i.e., to transport the document originals one by one from the main document setting plate 21 without subjecting the document originals to the copying process in the copying position 2*a*. At this time, the document partition portion 61 and the feed-out plate 62 are moved in the same manner as described above. Thereafter, Step S5 is performed to give the document transfer command to the auxiliary control section 210 in response to the start of the document non-processing transportation operation. Thus, the document transfer from the auxiliary document setting plate 82 to the main document setting plate 21 is performed in association with the one-by-one document non-processing transportation operation.

With the document feeder 70 according to this embodiment, document originals once set on the auxiliary document setting plate 82 on standby for the next copying operation can be automatically subjected to the copying process. Therefore, a user does not have to wait for the completion of the previous copying operation in front of the copying machine, thereby alleviating a user's burden.

Further, the document originals set on the auxiliary document setting plate 82 on standby for the next copying operation are transferred from the auxiliary document setting plate 82 to the main document setting plate 21 in association with the one-by-one document feeding from the main document setting plate 21. Therefore, the time required for the document transfer can be shortened in comparison with the case where the one-by-one document transfer is carried out after the completion of the document feeding from the main document setting plate 21. Thus, the use efficiency of the copying machine can be improved.

In addition, even if a stack of document originals is set on the auxiliary document setting plate 82 on standby for the next copying operation when the document feeding from the main document setting plate 21 is carried out in the final document feeding cycle, the document transfer from the auxiliary document setting plate 82 is carried out in association with the one-by-one non-processing transportation of the document originals which have been subjected to the copying operation. This also shortens the document transfer time.

While one embodiment of the present invention has thus been described in detail, the invention is not limited to the embodiment. In the foregoing embodiment, the completion of the document transfer from the auxiliary document setting plate 82 is determined on the basis of the time lapse. Alternatively, a sensor for detecting a document original may be provided adjacent to the second discharge roller pair 54 at the terminal of the transferring path 92 so that the completion of the document transfer is determined when the sensor does not detect any document original within a predetermined time period from the start of the document transfer.

The foregoing embodiment employs an RDH as the main document feeding portion 10. Alternatively, an automatic document feeder of the type which is, for example, designed to discharge an automatically fed document original into a special discharge tray may be employed as the main document feeding portion 10.

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application claims priority benefits under 35 USC Section 119 of Japanese Patent Application No. 8-319600 filed on Nov. 29, 1996, the disclosure thereof being incorporated herein by reference.

What is claimed is:

1. A document feeder, comprising:

a main document setting plate for holding thereon a stack of document originals to be processed;

an auxiliary document setting plate for holding thereon a stack of document originals to be processed after completion of the processing of the document originals set on the main document setting plate;

a transfer mechanism for transferring the document originals set on the auxiliary document setting plate to the main document setting plate;

a feeding mechanism for feeding the document originals set on the main document setting plate one by one to a predetermined processing position; and control means for controlling the transfer mechanism so that the document originals are transferred from the auxiliary document setting plate to the main document setting plate in synchronization with the document feeding from the main document setting plate to the processing position by the feeding mechanism.

2. A document feeder as set forth in claim 1, wherein the control means includes means for controlling the transfer mechanism so that the document originals set on the auxiliary document setting plate are transferred one by one onto the main document setting plate in synchronization with the one-by-one document feeding by the feeding mechanism.

3. A document feeder as set forth in claim 1, further comprising:

a document discharge tray for receiving the document originals once fed to the predetermined processing position from the main document setting plate and then discharged therein;

a document recycling mechanism for guiding to the main document setting plate the document originals once fed from the main document setting plate to the processing position and resetting the document originals on the main document setting plate;

document non-processing transportation means for performing a document non-processing transportation operation whereby the document originals once reset on the main document setting plate by the document recycling mechanism are discharged into the document discharge tray without processing the document originals; and associated transfer control means for controlling the transfer mechanism to transfer the document originals once set on the auxiliary document setting plate to the main document setting plate in synchronization with the document non-processing transportation operation performed by the document non-processing transportation means.

4. A document feeder as set forth in claim 3, wherein the associated transfer control means includes means for controlling the transfer mechanism so that the document originals set on the auxiliary document setting plate are transferred one by one onto the main document setting plate in synchronization with the one-by-one document non-processing transportation operation performed by the non-processing transportation means.

5. A document feeder as set forth in claim 3, wherein the document recycling mechanism includes a document recycling path for guiding the document originals from the processing position to the main document setting plate, and wherein the transfer mechanism includes a document transferring path extending from the auxiliary document setting plate and joining the document recycling path for guiding the document originals from the auxiliary document setting plate to the main document setting plate.

6. A document feeder as set forth in claim 3, further comprising:

recycling control means for controlling the document recycling mechanism to perform a document recycling cycle a plurality of times for transporting the document originals from the main document setting plate to the processing position and then back to the main document setting plate;

means for checking whether or not any stack of document originals is set on the auxiliary document setting plate;

cycle judgment means for judging whether or not a final document recycling cycle is performed, if the checking means detects a stack of document originals set on the auxiliary document setting plate;

means for allowing the associated transfer control means to control the transfer mechanism upon completion of the final document recycling cycle, if the cycle judgment means judges that the final document recycling cycle is being performed; and means for allowing the control means to control the transfer mechanism to discharge the document originals from the processing position into the document discharge tray upon completion of a document recycling cycle immediately before the final document recycling cycle, if the cycle judgment means judges that the final document recycling cycle is not being performed.

* * * * *